US008528337B2

(12) United States Patent
Berry et al.

(10) Patent No.: US 8,528,337 B2
(45) Date of Patent: Sep. 10, 2013

(54) LOBE NOZZLES FOR FUEL AND AIR INJECTION

(75) Inventors: Jonathan Dwight Berry, Simpsonville, SC (US); Gilbert Otto Kramer, Greer, SC (US)

(73) Assignee: General Electric Company, Schenectady, NY (US)

( * ) Notice: Subject to any disclaimer, the term of this patent is extended or adjusted under 35 U.S.C. 154(b) by 887 days.

(21) Appl. No.: 12/017,364

(22) Filed: Jan. 22, 2008

(65) Prior Publication Data

US 2009/0184181 A1 Jul. 23, 2009

(51) Int. Cl.
*F23R 3/30* (2006.01)

(52) U.S. Cl.
USPC ..... 60/748; 60/737; 60/740; 60/742; 60/746; 60/747

(58) Field of Classification Search
USPC ..... 239/554; 60/737, 740, 742, 746, 60/747, 748
See application file for complete search history.

(56) References Cited

U.S. PATENT DOCUMENTS

| | | | | |
|---|---|---|---|---|
| 3,750,402 | A | 8/1973 | Vdoviak et al. | |
| 3,973,395 | A | 8/1976 | Markowski et al. | |
| 4,005,657 | A | 2/1977 | Rothman | |
| 4,077,206 | A | 3/1978 | Ayyagari | |
| 4,215,536 | A | 8/1980 | Rudolph | |
| 4,481,698 | A | 11/1984 | Salerno | |
| 4,488,866 | A | 12/1984 | Schirmer et al. | |
| 4,887,425 | A | 12/1989 | Vdoviak | |
| 5,251,447 | A * | 10/1993 | Joshi et al. | 60/737 |
| 5,284,019 | A | 2/1994 | Vdoviak | |
| 5,315,815 | A * | 5/1994 | McVey et al. | 60/776 |
| 5,603,211 | A * | 2/1997 | Graves | 60/776 |
| 5,813,221 | A | 9/1998 | Geiser et al. | |
| 5,899,076 | A | 5/1999 | Snyder et al. | |
| 6,179,608 | B1 | 1/2001 | Kraemer et al. | |
| 6,257,147 | B1 | 7/2001 | Davies | |
| 6,513,329 | B1 * | 2/2003 | Snyder et al. | 60/737 |
| 6,880,340 | B2 | 4/2005 | Saitoh | |
| 6,974,090 | B2 | 12/2005 | Brax | |
| 6,983,604 | B1 | 1/2006 | Tafoya | |
| 2003/0058737 | A1 | 3/2003 | Berry et al. | |
| 2004/0006989 | A1 * | 1/2004 | Stuttaford et al. | 60/776 |
| 2004/0187946 | A1 | 9/2004 | Herrington | |

(Continued)

FOREIGN PATENT DOCUMENTS

| | | | |
|---|---|---|---|
| AU | 2007200350 | A1 | 8/2008 |
| JP | H0415409 | A | 1/1992 |

(Continued)

OTHER PUBLICATIONS

E.M. Greitzer, Title: "Internal Flow Concepts and Applications", Cambridge University Press, 2004, pp. 481-494.

(Continued)

*Primary Examiner* — William H Rodriguez
*Assistant Examiner* — Steven Sutherland
(74) *Attorney, Agent, or Firm* — Sutherland Asbill & Brennan LLP

(57) ABSTRACT

An injection system for fuel and air that includes a number of lobes positioned adjacent to each other. Each of the lobes has a trailing end. A number of jets may be positioned adjacent to the trailing end.

22 Claims, 5 Drawing Sheets

(56) References Cited

U.S. PATENT DOCUMENTS

| | | | | |
|---|---|---|---|---|
| 2005/0126755 | A1 | 6/2005 | Berry et al. | |
| 2005/0241319 | A1* | 11/2005 | Graves et al. | 60/776 |
| 2006/0070237 | A1 | 4/2006 | Johnson et al. | |

FOREIGN PATENT DOCUMENTS

| | | | |
|---|---|---|---|
| JP | H06330765 | A | 11/1994 |
| JP | H08145361 | A | 6/1996 |
| JP | 2001227745 | A | 8/2001 |
| JP | 2005180799 | A | 7/2005 |
| JP | 200690602 | A | 4/2006 |
| JP | 2006112775 | A | 4/2006 |
| JP | 2006523294 | A | 10/2006 |
| JP | 2007263538 | A | 10/2007 |

OTHER PUBLICATIONS

Notice of Reasons for Refusal from JP Application No. 2009-009421 dated Mar. 5, 2013.

* cited by examiner

LOBE NOZZLES FOR FUEL AND AIR INJECTION

TECHNICAL FIELD

The present application relates generally to gas turbines engines and more particularly relates to lobe-shaped premix injectors for use with fuel and air streams.

BACKGROUND OF THE INVENTION

In a gas turbine engine, it is common to mix the fuel and the air immediately upstream of a combustion zone. The fuel and the air must be mixed rapidly and sufficiently so as to produce a flow stream suitable for the combustion. The fuel and the air should be mixed, however, without flame holding or without forming recirculation zones. Such recirculation zones potentially could support flame holding or even an autoignition event that could cause damage to the turbine as a whole.

Various types of fuel and air injector configurations are now in use. The different configurations may be used to accommodate, in part, the specific nature and quality of the fuel and the combustion process. Each of these injector configurations, however, requires its own set of spare parts as well as specific installation, operation, and repair techniques. Likewise, many known injectors are made of relatively expensive cast parts and assembly processes.

There is a desire therefore, for an injection design that can be used across product lines. The injector preferably should be relatively low cost while providing sufficient mixing with a reduced possibility of flame holding or forming recirculation zones.

SUMMARY OF THE INVENTION

The present application thus describes an injection system for fuel and air. The injection system includes a number of lobes positioned adjacent to each other. Each of the lobes has a trailing end. A number of jets may be positioned adjacent to the trailing end.

The present application further describes an injection system for fuel and air. The injection system includes a number of lobes positioned adjacent to each other. Each of the lobes has a trailing end. A number of fuel jets and a number of air jets may be positioned adjacent to the trailing end.

The present application further describes an injection system for fuel and air. The injection system includes a number of vanes positioned adjacent to each other with each of the vanes including a trailing end. A number of fuel jets and a number of air jets are positioned adjacent to the trailing end.

These and other features of the present application will become apparent to one of ordinary skill in the art upon review of the following detailed description when taken in conjunction with the several drawings and the appended claims.

DETAILED DESCRIPTION

Figure 1:
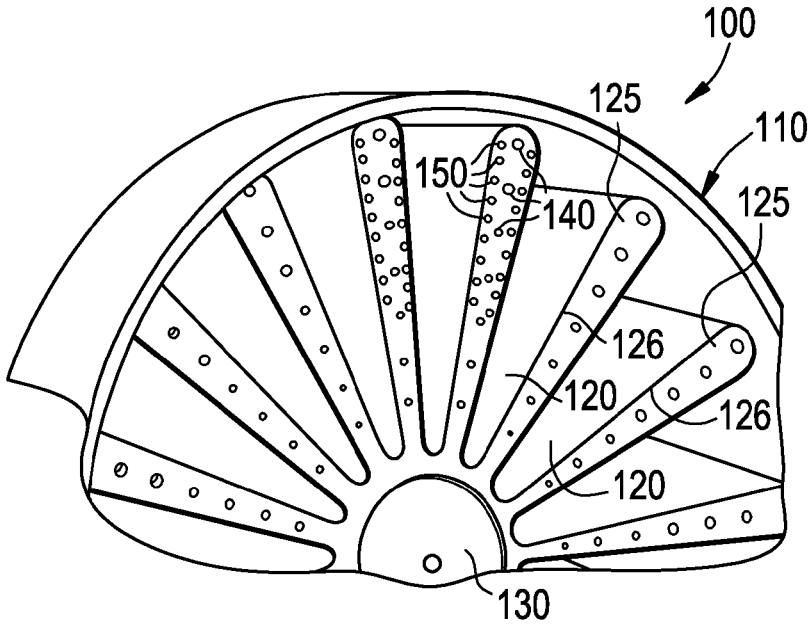
FIG. 1 is a perspective view of a lobe injection system with a swirl injector as is described herein.

Referring now to the drawings in which like numerals refer to like elements throughout the several views, FIG. 1 shows an example of a lobe injector system 100 as is described herein. In this example, the lobe injector system 100 incorporates a swirl injector 110. As is known, the swirl injector 110 generally includes a number of vanes or lobes 120. The lobes 120 may have any desired shape or configuration. Any number of lobes 120 may be used herein. Each pair of the lobes 120 defines an air pathway therebetween. The lobes 120 may be mounted about a hub 130.

Each lobe 120 of the lobe injector system 100 may have a number of large jets 140 positioned on an end plate 125 along a trailing edge 126 thereof. Each lobe 120 of the lobe injector system 100 also may have a number of small jets 150. The small jets 150 may be positioned at an angle along the end plate 125 or perpendicular to the end plate 125 and positioned adjacent thereto. In this example, an angle of about thirty degrees (30°) is shown. Any angle may be used herein including opposing jets 150 at about ninety degrees (90°) as is explained below. Any number of small jets 150 may be used. Likewise, the small jets 150 may have any size. Fuel therefore may be injected at an angle into the air stream at multiple points along each lobe 120. Air or an inert diluent also may be injected through one or more of the small jets 150. Multiple fuels and/or other gases also may be injected through the combined use of the large jets 140 and the small jets 150. The end plate 125 may or may not be used. Likewise, slot or sheet injection may be used.

Figure 2:
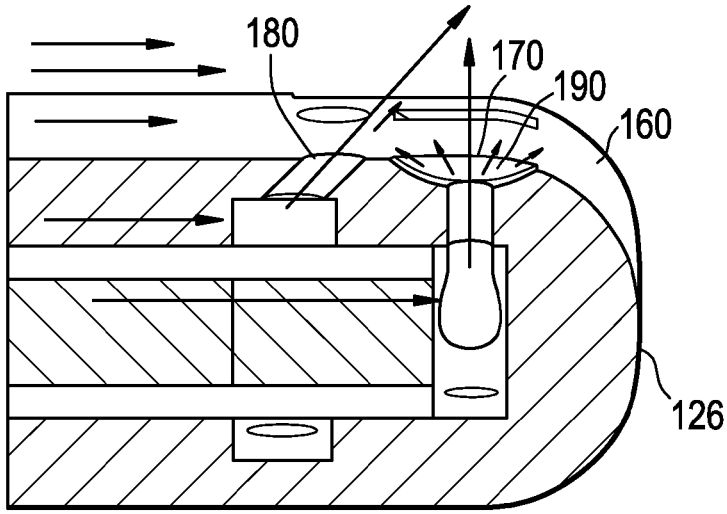
FIG. 2 is a side cross-sectional view of a lobe of the lobe injection system of FIG. 1.

FIG. 2 shows a further embodiment of a lobe 160. In this embodiment, the lobe 160 has an air jet 170 and a fuel jet 180. The fuel jet 180 may be angled with respect to the air jet 170 as is shown. The air jet 170 may be positioned downstream of the fuel jet 180. The downstream air jet 170 provides for rapid mixing of the fuel. Alternatively, the air jet 170 may be positioned upstream of the fuel jet 180 such that the air can impinge on the fuel jet 180 and further increases the possibility of rapid mixing.

Figure 3:
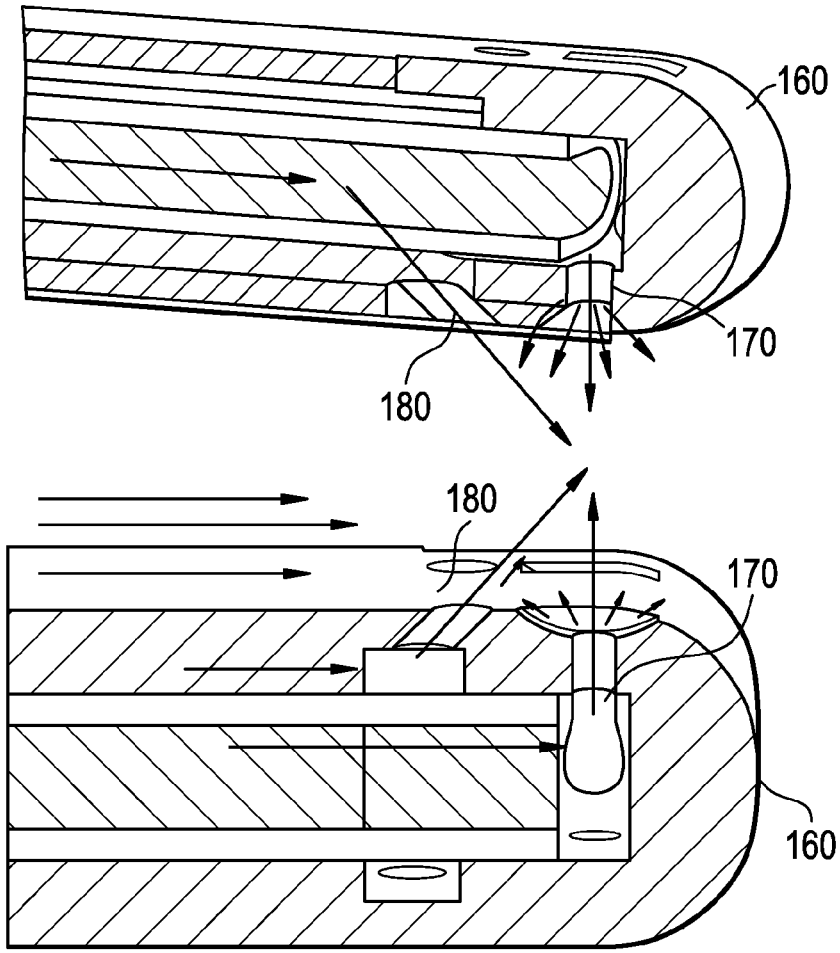
FIG. 3 is a side cross-sectional view of a pair of lobes of the lobe injection system of FIG. 1.

The air jet 170 may have a scalloped region 190. The scalloped region 190 also reduces flame holding potential. The number, size, and orientation of the jets 170, 180 may vary. As is shown in FIG. 3, opposing lobes 160 may be used so as to enhance further mixing via the air and the fuel streams colliding.

Figure 4:
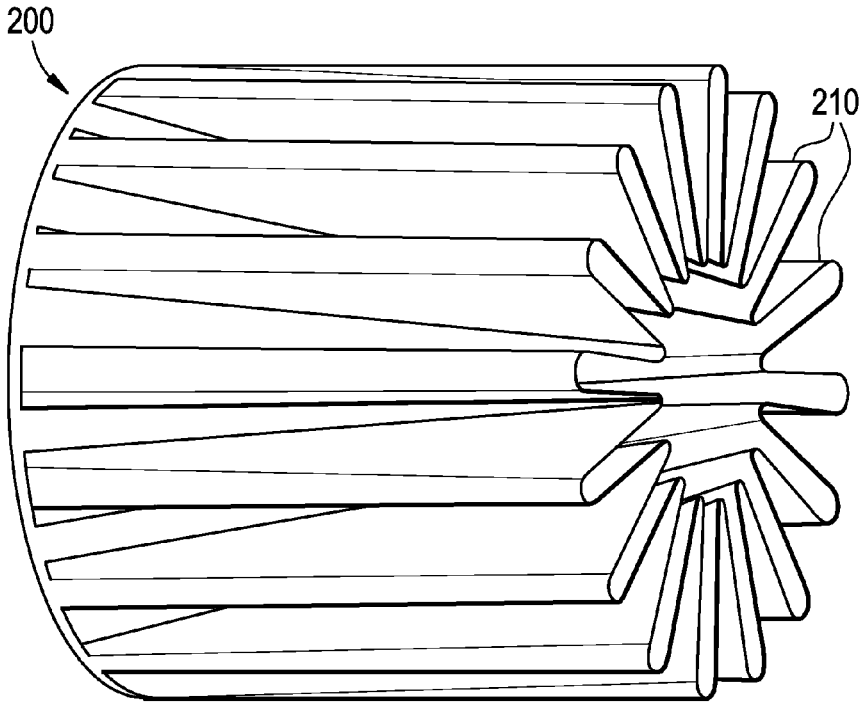
FIG. 4 is a perspective view of a lobe injection system with a non-swirl injector as is described herein.
Figure 5:
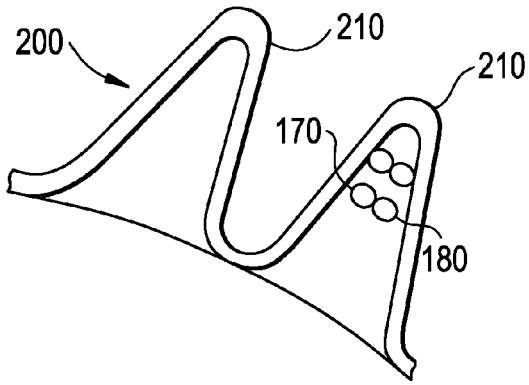
FIG. 5 is a front plan view of a pair of lobes of the lobe injection system of FIG. 4.

FIGS. 4 and 5 show a further embodiment of the lobe injector system 100. In this example, a non-swirl injector 200 is shown. The non-swirl injector 200 also includes a number of lobes 210. The lobes 210 may or may not include the air and the fuel jets 170, 180 as is described above. Sheet injection with a diluent blanket may be used for high diluent effectiveness.

Figure 6:
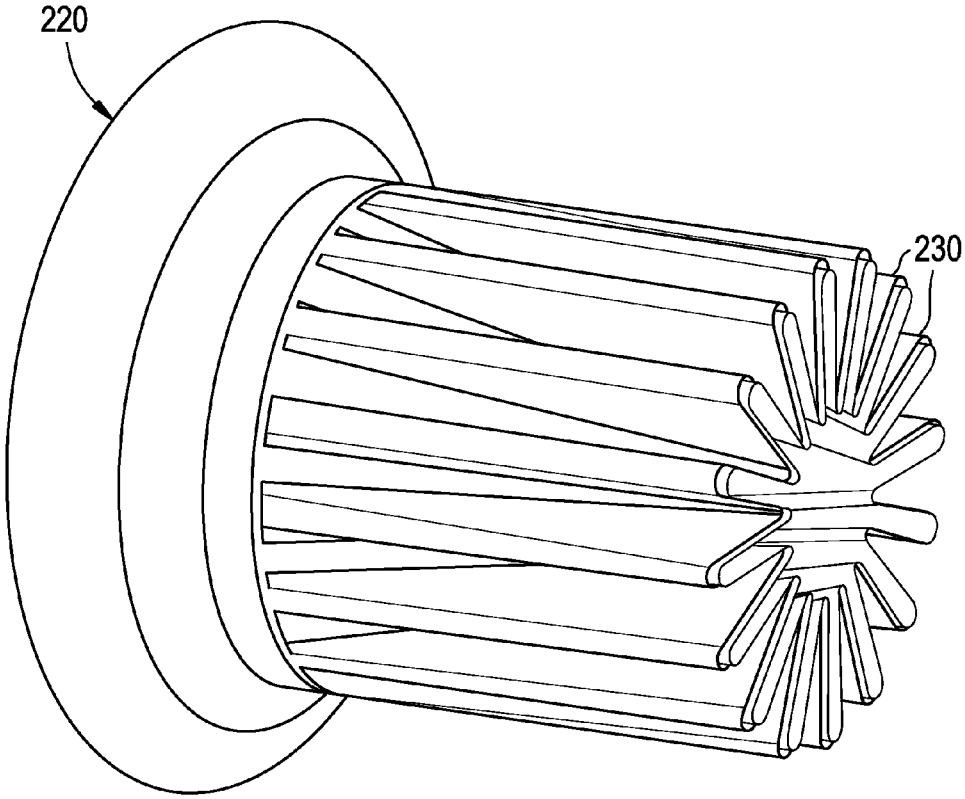
FIG. 6 is a perspective view of a lobe injection system with a number of nested lobes as is described herein.
Figure 7:
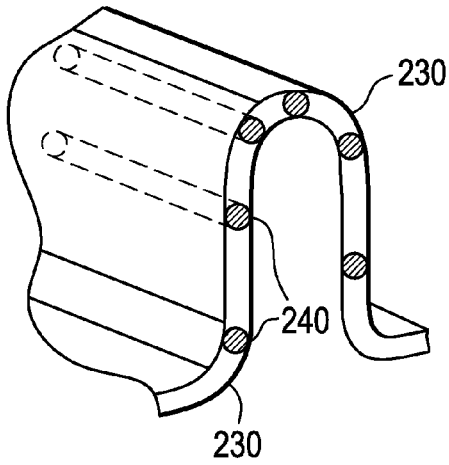
FIG. 7 is a perspective view of a number of nested lobes with spacers therein.

A further example of the lobe injector system 100 is shown in FIG. 6. In this example, a nested injector 220 is shown. The nested injector 220 includes a number of lobes 230 nested within each other. The air and/or the fuel jets 170, 180 also may be used herein. The lobes 230 may be axially staged for multiple fueling paths. Other configurations may be used herein. A nested outer lobe also may be used for impingement cooling. As is shown in FIG. 7, a number of spacers 240 may be used between the lobes 230. The spacers 240 may provide spacing and structure to the lobes 230 as well as defining flow paths therethrough. The spacers 240 also may enable a means of flow control for diffusion flame configurations.

Figure 8:
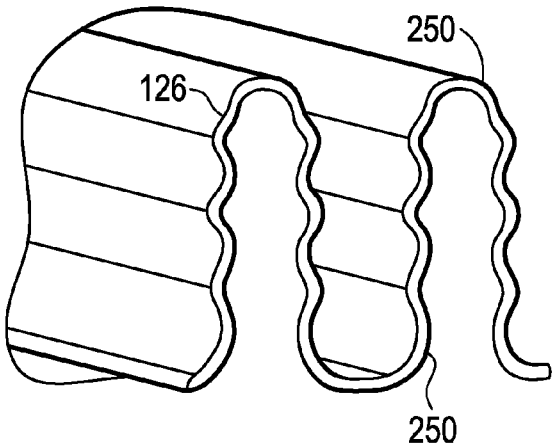
FIG. 8 is a perspective view of a pair of nested lobes with a lobed shape.

As is shown in FIG. 8, the lobes 230 themselves also may have a lobed or a sinusoidal shape. In this example, a number of lobes 250 may have the lobed shape so as to increase mixing at the trailing edge 126 thereof and to provide a stable flame structure. Other shapes may be used herein. The lobes 250 may be nested or unnested.

The components of the lobe injector system 100 may be made out of conventional sheet metal or similar materials as well as casting or more expensive techniques or materials. The less expensive materials may be used given the positioning of the jets 170, 180 and the lack of flame holding on the metal. The same general design may be used for various types of turbines, including, but not limited to, DLN (Dry Low $NO_x$) and IGCC (Integrated Gasification Combined Cycle), MNQC (Multi-Nozzle Quiet Combustor), and otherwise.

The lobe injector system 100 thus may provide uniformity across product lines and a resulting cost benefit. The lobe injector system 100 may be original equipment or a retrofit and may be scalable. Specifically, the size, number, and positioning of the jets 140, 150, 170, 180 may be changed to accommodate different fuels or gases. The lobe injector system 100 further provides fuel flexibility in that large variations in fuel flows may be accommodated, i.e., low volume/high BTU flows and high volume/low BTU flows may be used. Likewise, the air may be ambient, purge air, steam, nitrogen, other inert gasses, or another fuel stream.

By moving the jets 140, 150, 170, 180 to the trailing edge 126 of the lobes 120, the possibility of flame holding is reduced. Likewise, the fuel-air mixing time likewise is reduced in that the lobe injector system 100 allows for more fuel and air passages to interact, thus providing more fuel injection points so as to provide better mixing. Flame holding margins therefore may be reduced. The lobe injector 100 thus addresses the issue of costs, flame holding, mixing, fuel flexibility, and a unified design. The design is flexible with many variations.

The lobes 120 may be segmented to increase design flexibility and durability. As described above, the end plate 125 may or may not be used. The lobes 120 may use outer shells or other structures to aid in directing the airflow therethrough. The outer shells may form lobe module. Although circular structures are shown herein, the lobes 120 may be modular in nature and may take a square shape, a rectangular shape, or any desired shape and structure. Lobes 120 of varying heights also may be used.

Figure 9:
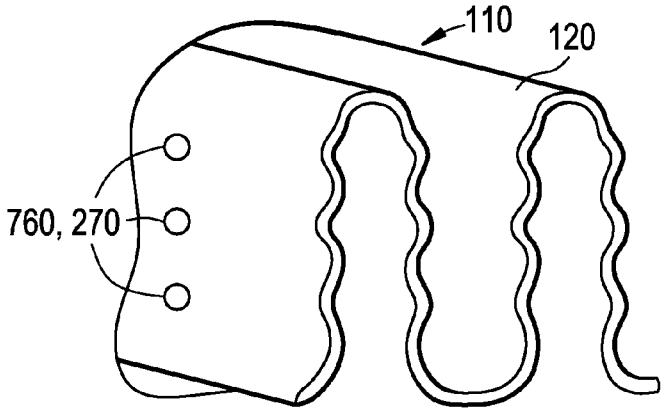
FIG. 9 is a perspective view of a lobe with an upstream jet.

The lobe injection system 110 also may have additional air jets 260 or fuel jets 270 positioned upstream of the trailing edge 126 as is shown in FIG. 9. Upstream injection may be used within the same fuel circuit. For example, natural gas may be injected upstream with a syngas at the trailing edge 126. Fuel injection upstream of the trailing edge 126 can provide cooling to the lobes 120 and potentially extend the useful lifetime. Likewise, an inert air may be injected upstream to reduce flame holding potential with a syngas.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. An injection system for fuel and air, comprising:
a plurality of lobes positioned adjacent to each other and defining an air pathway therebetween;
each of the plurality of lobes comprising a leading edge and a trailing edge;
an end plate connected to the trailing edge of each lobe;
a plurality of fuel jets and a plurality of air jets positioned adjacent to the trailing end and closer to the trailing end than the leading end.

2. The injection system of claim 1, wherein the plurality of jets comprises a position adjacent to the trailing edge at an angle thereto.

3. The injection system of claim 2, wherein the angle comprises thirty degrees)(30°)to ninety degrees(90°) .

4. The injection system of claim 1, wherein the plurality of air jets comprises a scalloped region.

5. The injection system of claim 1, wherein the plurality of fuel jets comprises an angle relative to the plurality of air jets.

6. The injection system of claim 1, wherein the plurality of fuel jets comprises a plurality of fuels.

7. The injection system of claim 1, wherein the end plate comprises a plurality of end plate jets.

8. The injection system of claim 1, wherein the plurality of lobes comprises a nested injector.

9. The injection system of claim 8, further comprising a plurality of spacers positioned about the plurality of lobes.

10. The injection system of claim 1, wherein the plurality of lobes comprises a sinusoidal shape.

11. The injection system of claim 1, wherein one or more of the plurality of lobes comprise one or more upstream jets.

12. An injection system for fuel and air, comprising:
a plurality of lobes positioned adjacent to each other and defining an air pathway therebetween;
each of the plurality of lobes comprising a leading edge and a trailing edge;
an end plate connected to the trailing edge of each lobe;
a plurality of fuel jets and a plurality of air jets positioned adjacent to the trailing edge and closer to the trailing edge than the leading edge.

13. The injection system of claim 12, wherein the plurality of fuel jets are positioned downstream of the plurality of air jets.

14. The injection system of claim 12, wherein the plurality of air jets are positioned downstream of the plurality of fuel jets.

15. The injection system of claim 12, wherein the plurality of fuel jets comprise an angle relative to the plurality of air jets.

16. The injection system of claim 12, wherein the plurality of air jets comprises a scalloped region.

17. The injection system of claim 12, wherein the plurality of fuel jets comprises a plurality of fuels.

18. The injection system of claim 12, wherein the plurality of lobes comprise a swirl injector.

19. The injection system of claim 12, wherein the plurality of lobes comprises a non-swirl injector.

20. The injection system of claim 12, wherein the plurality of lobes comprises a nested injector.

21. The injection system of claim 12, wherein one or more of the plurality of lobes comprise one or more upstream jets.

22. An injection system for fuel and air, comprising:
a plurality of lobes positioned adjacent to each other and defining an air pathway therebetween;
each of the plurality of lobes comprising a leading edge and a trailing edge;
an end plate connected to the trailing edge of each lobe;

a plurality of fuel jets and a plurality of air jets positioned adjacent to the trailing edge and closer to the trailing edge than the leading edge;

and wherein a first flow of fuel from the plurality of fuel jets of a first lobe intersects a second flow of fuel from the plurality of fuel jets of a second lobe adjacent to said first lobe.

* * * * *

UNITED STATES PATENT AND TRADEMARK OFFICE

CERTIFICATE OF CORRECTION

PATENT NO. : 8,528,337 B2
APPLICATION NO. : 12/017364
DATED : September 10, 2013
INVENTOR(S) : Jonathan Dwight Berry et al.

It is certified that error appears in the above-identified patent and that said Letters Patent is hereby corrected as shown below:

On the Title Page, Item (75), 2nd Inventor should read:

--Gilbert Otto Kraemer, Greer, SC (US)--

Signed and Sealed this
Twenty-second Day of April, 2014

Michelle K. Lee

Michelle K. Lee
*Deputy Director of the United States Patent and Trademark Office*